United States Patent [19]

McKissack

[11] Patent Number: 4,859,868

[45] Date of Patent: Aug. 22, 1989

[54] ELECTRIC FENCE ENERGIZER

[75] Inventor: Jeremy J. McKissack, Hamilton, New Zealand

[73] Assignee: Gallagher Electronics Limited, Hamilton, New Zealand

[21] Appl. No.: 242,799

[22] Filed: Sep. 9, 1988

Related U.S. Application Data

[63] Continuation-in-part of Ser. No. 67,941, Jun. 29, 1987, abandoned.

[30] Foreign Application Priority Data

Jul. 4, 1986 [NZ] New Zealand ..... 216748
Mar. 6, 1987 [NZ] New Zealand ..... 219542

[51] Int. Cl.[4] ..... H01H 47/00

[52] U.S. Cl. ..... 307/106; 307/107; 307/108; 307/132 R; 361/232; 256/10

[58] Field of Search ..... 307/38, 11, 118, 132 R, 307/415, 106–110, 412–421, 265; 328/53, 65, 67; 315/200 R, 209 R, 209 LD, 209 T, 209 SC, 209 M; 361/232; 256/10

[56] References Cited

U.S. PATENT DOCUMENTS

| | | | |
|---|---|---|---|
| 3,051,449 | 8/1962 | Legrand | 256/10 |
| 3,205,378 | 9/1965 | Kline | 307/132 R |
| 3,655,994 | 4/1972 | Malme | 307/132 R |
| 3,655,995 | 4/1972 | Malme | 307/132 R |
| 3,772,601 | 11/1973 | Smith | 328/65 |
| 4,322,817 | 3/1982 | Kuster | 363/41 X |
| 4,394,583 | 7/1983 | Standing | 307/108 |
| 4,396,879 | 8/1983 | Weinreich et al. | 361/232 X |
| 4,456,835 | 6/1984 | Pichler et al. | 307/107 |

*Primary Examiner*—William M. Shoop, Jr.
*Assistant Examiner*—Paul Ip
*Attorney, Agent, or Firm*—Abelman Frayne Rezac & Schwab

[57] ABSTRACT

This invention relates to an electric fence energizer, including: two or more transformers, the primary windings of said transformers being connected to the main circuitry of the energizer and the secondary windings of the transformers being connected to an electric fence, the main circuitry including: a control circuit connected to the primary windings, said control circuit being responsive to the load upon the primary windings or secondary windings detected within the energizer; two or more energy generating devices connected to said control circuit and respectively controlled by said control circuit, said energy generating devices being also connected to the primary windings of the transformers, said control circuit being operative to active the energy generating devices in accordance with the load upon the energizer.

6 Claims, 5 Drawing Sheets

ELECTRIC FENCE ENERGIZER

BACKGROUND OF THE INVENTION

The load on an electric fence energiser can be quite variable according to a number of factors such as the moisture content of the ground, leakage at fence posts and of course the electrical resistance that occurs when an animal comes in contact with the fence. So as to detect whether an animal has come in contact with the fence it is necessary for energisers to periodically send out electrical pulses.

Most electric fence energisers can only provide a single output pulse which is fed to the fence regardless of the load. The pulse needs to be sufficiently powerful to deter an animal in contact with the fence, however, it is wasteful if the fence load is light. With an energiser operating above fence load requirements as in the above situation the life of the energiser is often unnecessarily reduced.

Direct measurement of the load on a transformer within the energiser is difficult as a number of countries have safety regulations that require 10 000 volts isolation between the primary and secondary coils and transformers.

Efforts have been made to address the above problem and electric fence energisers that have varied pulses are known. For instance, U.S. Pat. No. 2,981,854 discloses an energiser that continuously and alternately charges the fence with high and low voltage surges. This however does not have a means of monitoring the actual fence load and therefore cannot selectively respond according to the load.

U.S. Pat. No. 3,378,694 does monitor load requirements but the monitoring means is not from within the energiser but via a "feeler" which determines the conductivity of the soil into which the feeler is placed. This provides an unrepresentative value depending on the location of the feeler and does not test directly the load to which the energiser itself is operating under.

Another problem associated with electric fence energisers is that they are responsible for radio interference by the nature of their operation and in countries that rely heavily upon radio communication a reduction of the source of interference would be welcomed.

It is an object of the present invention to provide an electric fence energiser that addresses the above problems.

Further objects and advantages of the present invention will become apparent from the ensuing description which is given by way of example.

SUMMARY OF THE INVENTION

According to the broadest aspect of the present invention there is provided an electric fence energiser, including:

two or more transformers, the primary windings of said transformers being connected to the main circuitry of the energiser and the secondary windings of the transformer being connected to an electric fence, the main circuitry including:

a control circuit connected to the primary windings, said control circuit being responsive to the load upon the primary windings or secondary windings detected within the energiser:

two or more energy generating devices connected to said control circuit and respectively controlled by said control circuit, said energy generating devices being also connected to the primary windings of the transformers, said control circuit being operative to activate the energy generating devices in accordance with the load upon the energiser.

The load on the energiser or a representative value thereof, may be detected in a number of ways. For instance a sense line can be connected to at least one primary winding and to the control circuit which provides a representative value of the voltage across the primary side of the energiser circuitry which is directly related to the load upon the energiser.

An alternative method of detecting the load on the energiser is by detecting a current passing through the primary side of the energiser circuitry by measuring the voltage across a known resistance on the primary side with sense lines that are connected to the control circuitry.

The load on the energiser can be detected from the secondary side of the energiser circuitry, however it should be appreciated that due to the required voltage isolation, direct coupling with the primary side circuitry and hence the control circuit is not possible. This may be overcome by using an optical transmitter which is voltage or current driven in the secondary side of the circuit that transmits a representative value to an optical receiver connected to the control circuit on the primary side of the circuit thus creating an optically isolated circuit.

A further way of detecting the load upon the energiser can be by measuring a component or free space temperatures within the energiser with a thermal sensor such as thermistor which is connected to the control circuitry.

Unlike the prior art, the present invention contains means of obtaining a representativew value of the load upon an energiser from within the energiser circuitry, said representative values being received by control circuitry which interprets same and activates the energiser accordingly.

The energy generating devices may comprise storage capacitors each connected to the power supply and a transformer within the energiser. It is considered immaterial whether the power supply is AC or DC as the present invention can be easily adapted to work from either. In the simplest version of the present invention two energy generating devices may be used however it is to be appreciated that any number of such generating devices may be provided, each with different capacities. The control circuitry may then be arranged to stage the output of these devices in accordance with the load condition. One way of achieving this is to have one generating device operating continuously to detect the load, although this need not necessarily be the case.

The control circuit may control the generating devices by the opening and closing of switches within the energy generating devices. For instance, the pulse generator device may include a storage capacitor connected parallel with the primary winding of the transformer with an SCR interposed in series with the capacitor and transformer. The gate of the SCR may then be connected to the control circuit. Under normal operating conditions, that is, there is no extra load upon the fence, a first generating device may be operating to send pulses down the electric fence line to test whether there is any load thereupon. Once a load is detected within the energiser, perhaps by means discussed above, the control circuit may then trigger an SCR associated with another generating device, thus providing a path for the charge on the second storage capacitor, causing both generating devices to respond to the load and electrify the fence line accordingly.

The control circuit may also contain within it a safety feature which disables all but the first generating device if an extremely light or heavy load is sensed such as that which would occur if the fence line is broken or shorted respectively.

Problems with radio interference that arise from use of the electric fence energisers may be avoided by the introduction of resonant transformer circuitry in combination with staged output control as disclosed in the present invention. In most countries electric fence energisers are tested to ensure that they comply will certain standards, including standards relating to the avoidance of radio interference. The present invention may be constructed such that the load required to trigger the second generating device is greater than the load used to test the energiser. Thus, when the energiser is tested, only the low power pulse in the normal mode of operation is actually tested and not the high power pulse which gives rise to for more radio interference. By having an inductor in combination with the storage capacitor and transformer of the first generating device, a resonant transformer circuit is formed which slows the rate of discharge from the first energy storage capacitor and therefore reduces the radio interference which usually arises from sharp voltage spikes.

Aspects of the present invention will now be discussed with reference to the accompanying drawings.

DETAILED DESCRIPTION OF A PREFERRED EMBODIMENT

Figure 1:
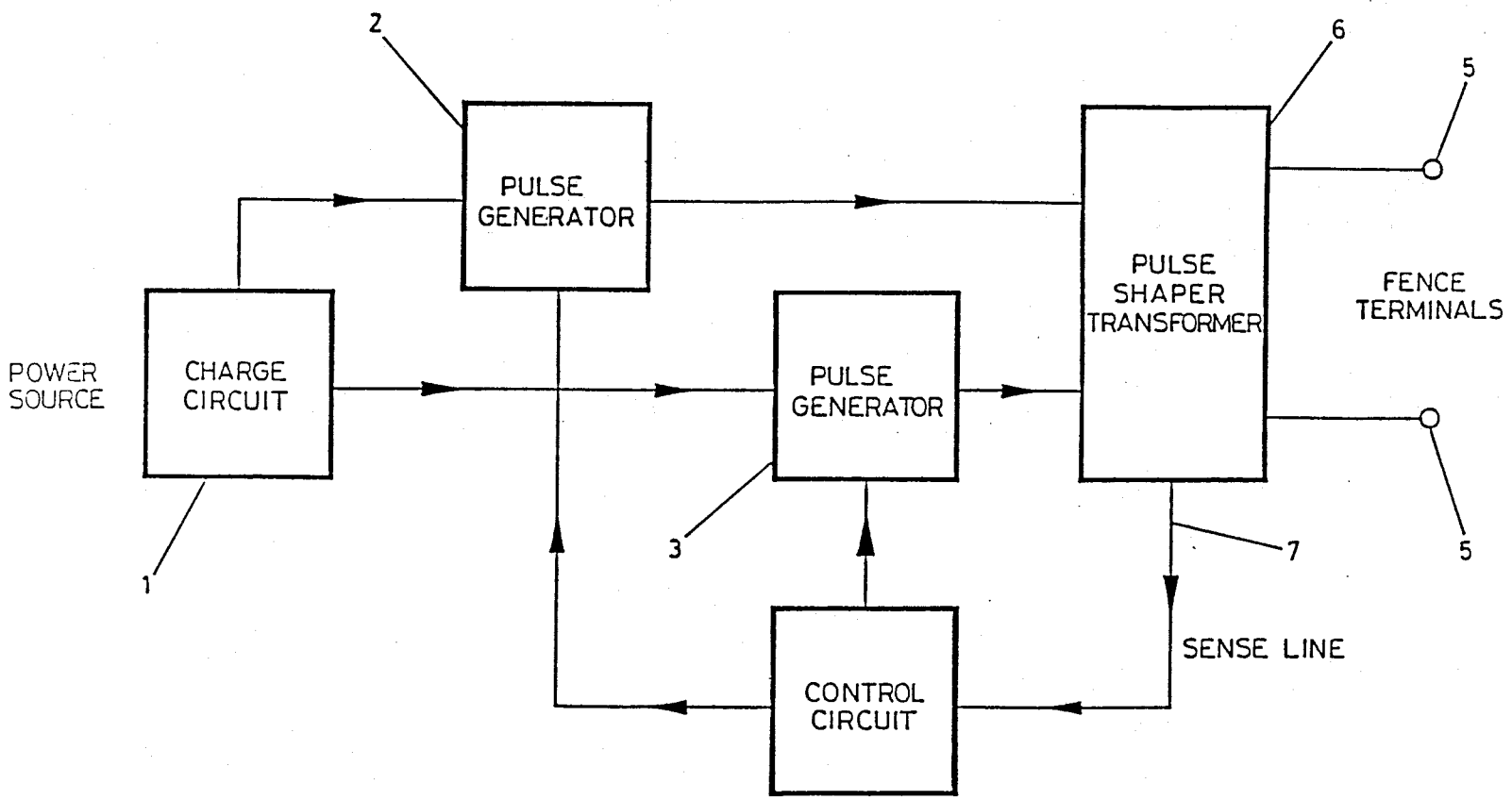
FIG. 1: is a component block diagram of an electric fence energiser in accordance with one possible embodiment of the present invention.

With reference to FIG. 1, in a preferred form of the invention the electric fence energiser comprises a charging circuit 1 which feeds two separate energy generating devices or pulse generators 2, 3 each of which is controlled by a control circuit. Output pulses from the generators 2, 3 are fed to the fence terminals 5 via a pulse shaper device 6.

A sense line 7 is drawn from the pulse shaper transformer to the control circuit, however it should be appreciated that the representative loads on the sense line detected may not necessarily originate from the pulse shaper device 6.

Figure 2:
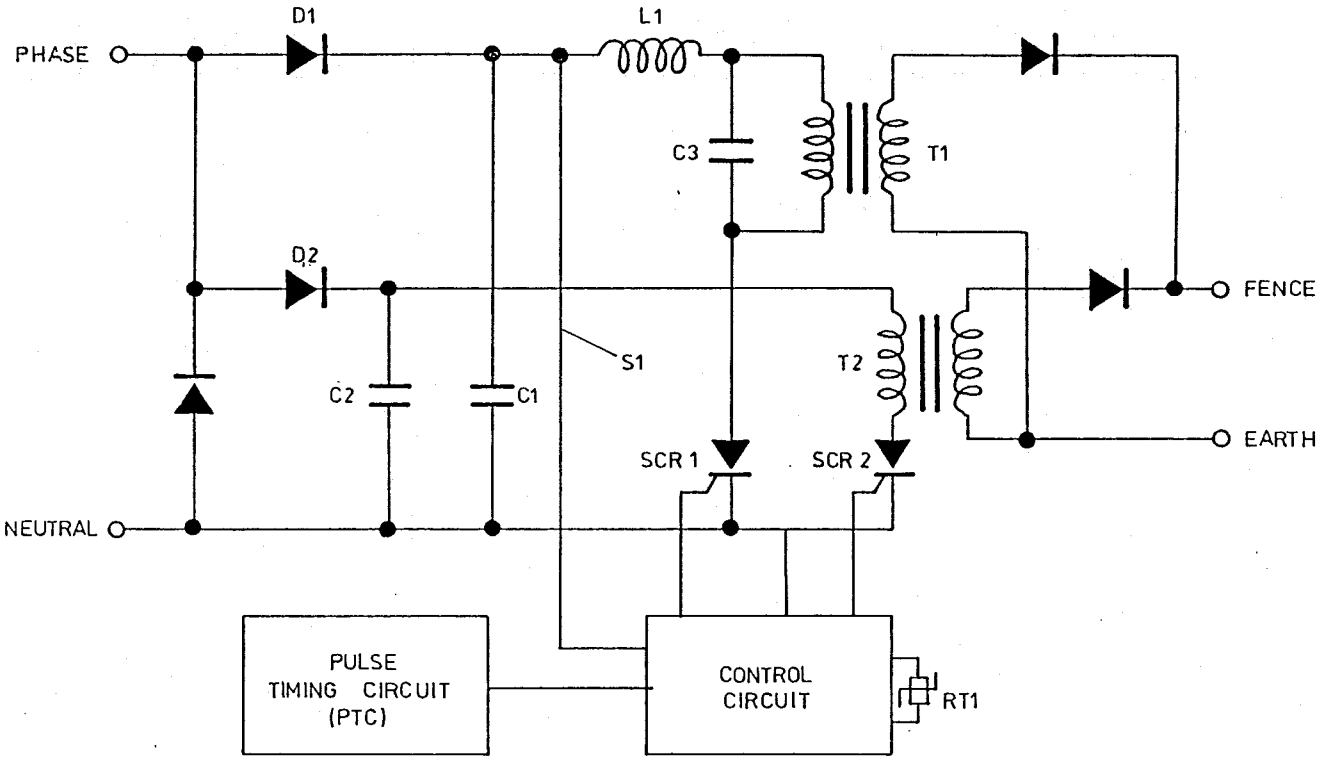
FIG. 2: is an example of one possible circuit for an electric fence energiser in accordance with the present invention which detects the load on the energiser by measuring the voltage on the primary side of the energiser circuit.

FIG. 2 is a more detailed description of an electric fence energiser as described in FIG. 1 with the detecting of the energiser load being measured in two ways.

Pulse generator 2 is represented in FIG. 2 by a combination of diode D1, capacitor C1, transformer T1 and SCR1. Likewise the pulse generator 3 is represented by diode D2, capacitor C2, transformer T2 and SCR2.

The pulse shaper in FIG. 1 has its equivalent in L1 and C3 of FIG. 2 which together with the transformer T1 forms resonant transformer circuitry that slows the rate of discharge from the capacitor C1 sufficiently to reduce radio interference which usually arises from the direct discharge of a storage capacitor.

The operation of the energiser circuit is shown in FIG. 2 as follows. Capacitor C1 is charged up from the main power supply until the pulse timing circuit PTC causes the control circuit to trigger SCR 1 which releases the stored energy of the capacitor C1 as a pulse along the fence line. This is a low powered pulse which is repeated at regular intervals and is used to detect the load on the fence line.

Once there is a load on the fence line sense line S1 which is connected between the positive rail and the control circuit causes the control circuit to trigger SCR2 bringing the second pulse generator to action by discharging C2 to provide a much larger pulse along the fence line. Once the load on the fence line is removed, for instance the animal walks away, the sense line causes the control circuit to close the SCR2 thus leaving only the first pulse generator in operation.

Alternatively the turning on and off of the SCR2 by the control circuit may depend upon the resistance sensed of a temperature dependent resistor RT1. The resistor RT1 monitors a component or free space temperatures within the energiser which is a factor that is related to the load upon the energiser.

Thus once either the temperature sensed by RT1 or the voltage sensed by sense line S1 falls below a predetermined level, the control circuit fires SCR2 thereby achieving the required pulse generation staging.

In the case that either the fence line is broken or shorted there is going to be respectively either an extremely light load on the energiser or an extremely heavy load. In these conditions the control circuit disables the SCR2 leaving only the first pulse generator in operation. This is thought to be an important safety feature.

Figure 3:
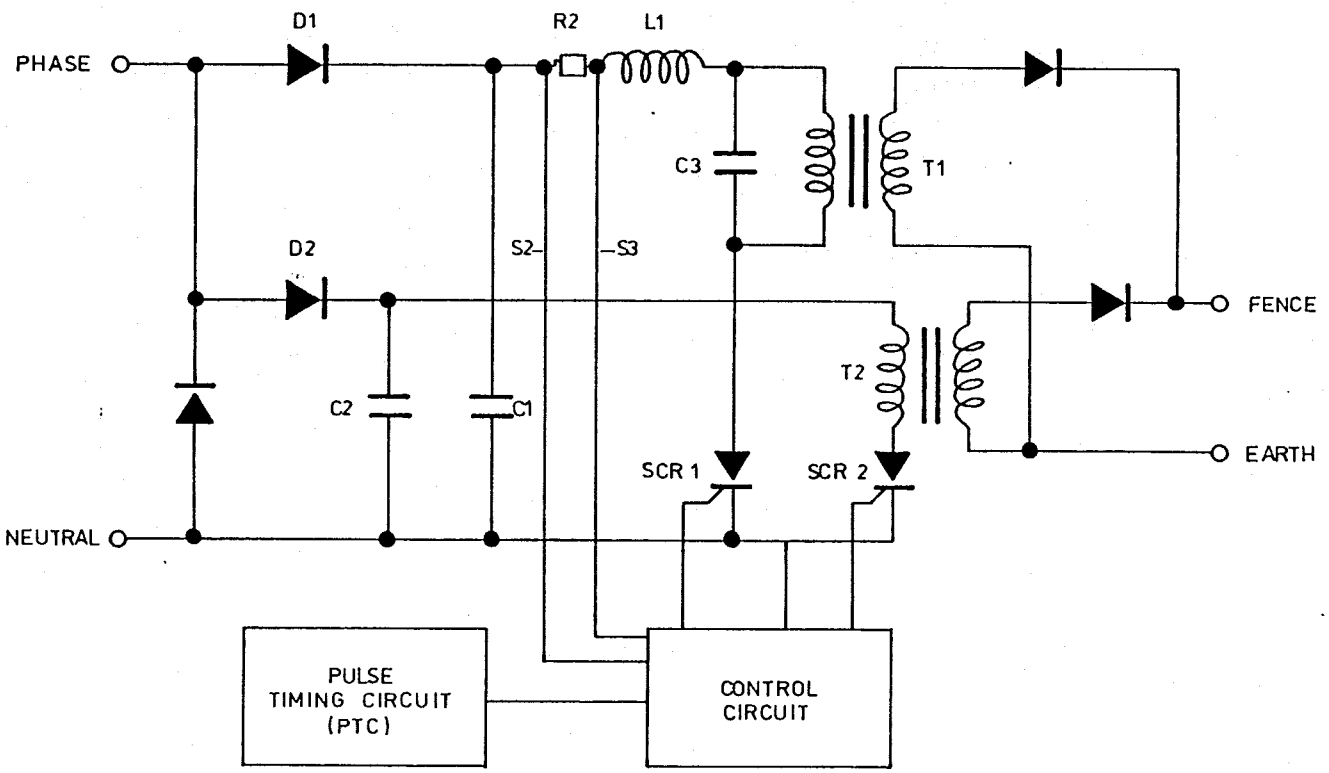
FIG. 3: is a circuit diagram of an electric fence energiser in accordance with the present invention that detects the load on the energiser by measuring the current passing through the primary side of the energiser circuit.
Figure 4:
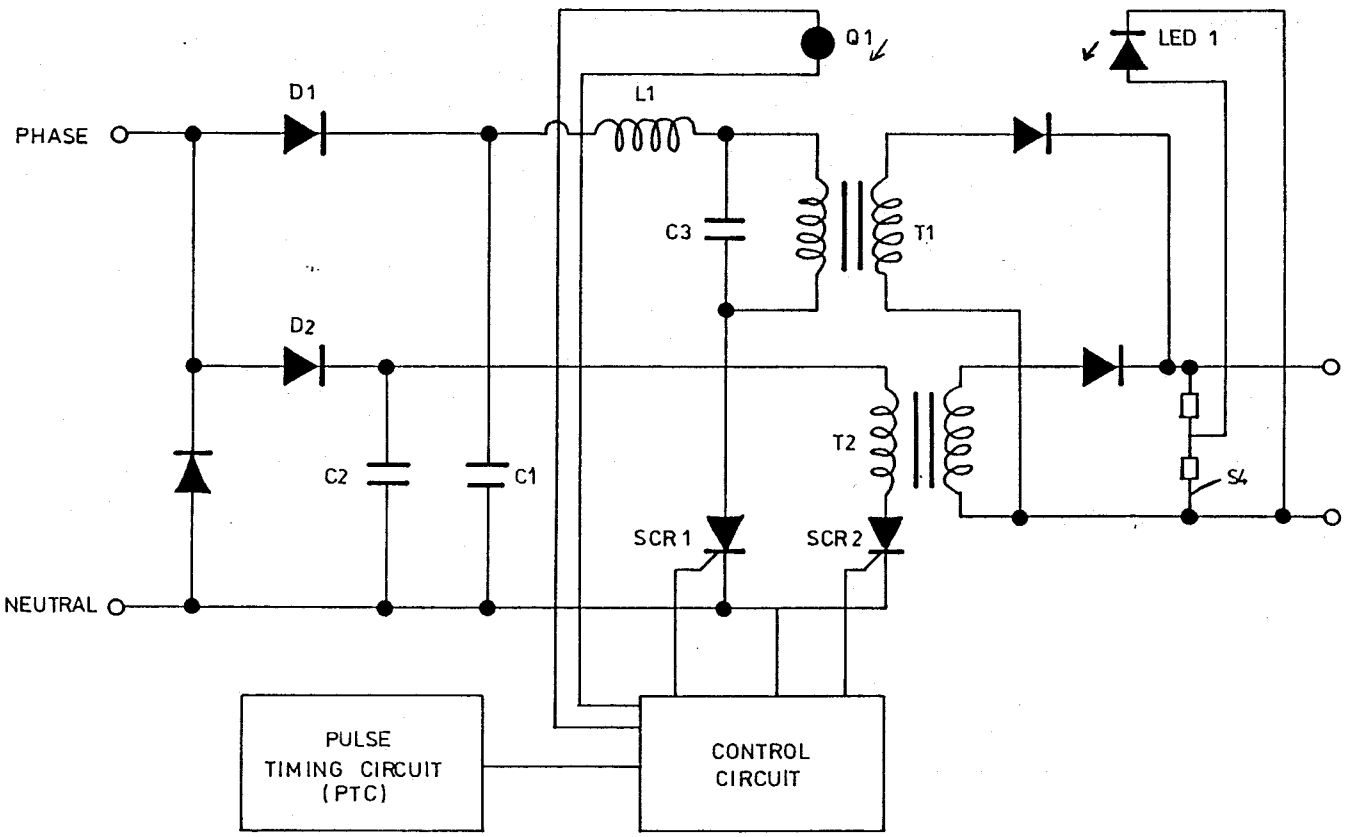
FIG. 4: is a circuit diagram of an electric fence energiser in accordance with the present invention that detects the load on the energiser but measuring the voltage on the secondary side of the energiser circuit.
Figure 5:
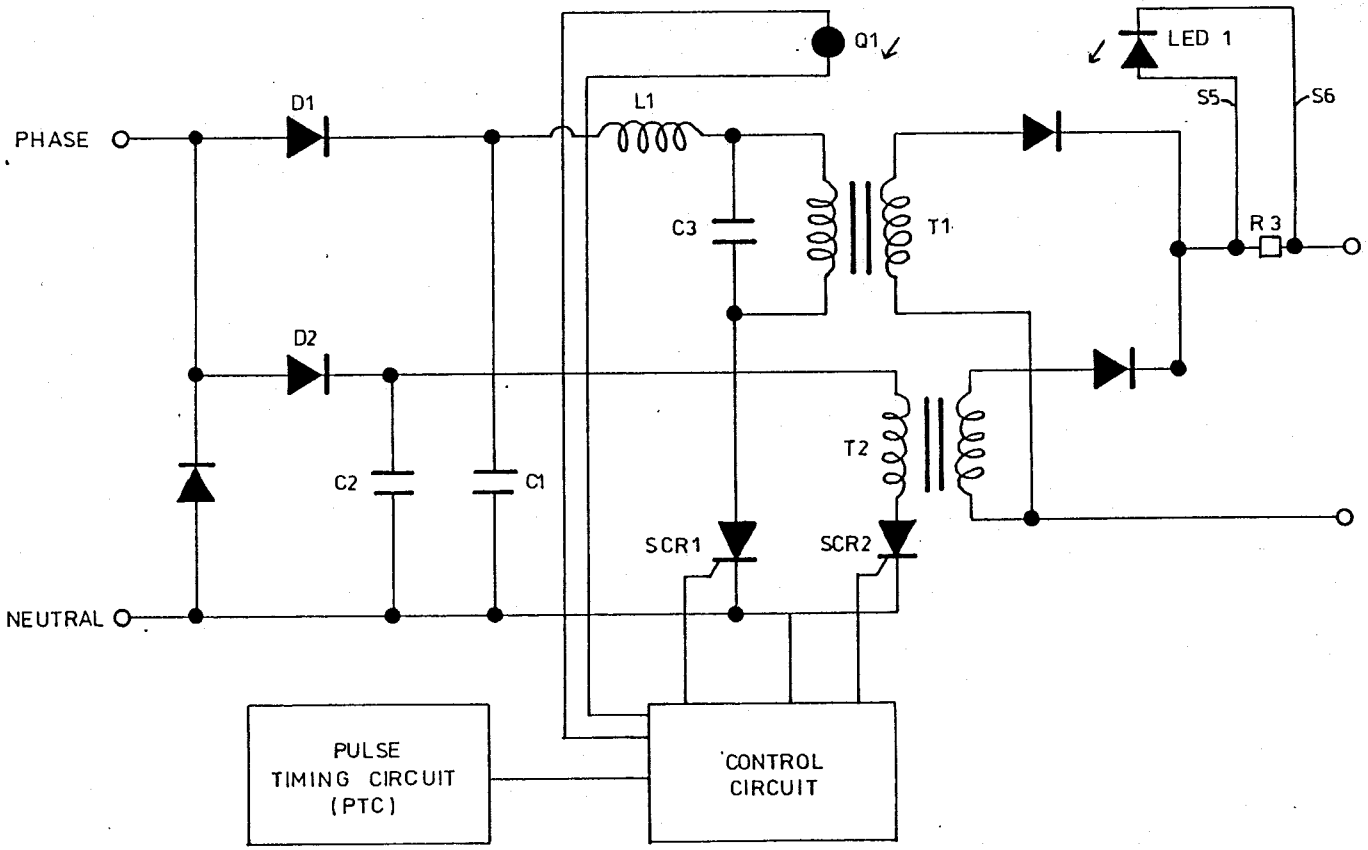
FIG. 5: is a circuit diagram of an electric fence energiser in accordance with the present invention that detects the load on the energiser by measuring the current on the secondary side of the energiser circuit.

FIGS. 3, 4 and 5 are very similar circuit diagrams to that in FIG. 2 with the exception of the load sensing means.

FIG. 3 shows two sense lines S2 and S3 connected to either side of resistor R2, which has a known value and to the control circuit. Thus the sensing of the load upon the energiser is by measuring the current on the primary side of the circuit.

FIG. 4 illustrates the measuring of the load upon the energiser from the secondary side of the circuit with sense line S4 to detect the voltage. This is connected to an optical transmitter LED 1 which is optically coupled to an optical receiver Q1 which is in turn coupled to the control circuit. As discussed optical coupling is necessary with the requirement of voltage isolation.

Finally FIG. 5 illustrates the detecting the load of the current across a known resistor R3 with sense lines S5 and S6. Again a representative value of the load is transmitted by optical coupling to the control circuit.

Aspects of the present invention have been described by way of example only and it will be appreciated that modifications and additions thereto may be made without departing from the scope thereof as defined in the appended claims.

I claim:

1. An electric fence energizer, including:

a first energy generating circuit including a first transformer having a primary winding connected across an output of said first energy generating circuit and having a secondary winding for connection to a fence wire;

a second energy generating circuit including a second transformer having a primary winding connected across an output of said second energy generating circuit and having a secondary winding for connection to said fence wire;

a control circuit having a first output connected to said first energy generating circuit for controlling said first energy generating circuit, and having a second output connected to said second energy generating circuit for controlling said second energy generating circuit independently of said first energy generating circuit; and, a control line connected to an input of said control circuit and also connected to a means of said first generating circuit responsive to a change in operating conditions occuring in said first energy generating circuit, said means being operative to trigger said control circuit and energize said second energy generating circuit on the occurence of a change in operating conditions of said first energy generating circuit.

2. The electric fence energizer of claim 1, in which said responsive means is a connection to said first energy generating circuit at a point in which an increased load on said secondary of said first energy generating circuit appears as a voltage drop in said first energy generating circuit at said point.

3. The electric fence energizer according to claim 1, in which said responsive means is a resistor connected in series with a line circuit of said first energy generating circuit, said resistor producing a current indicative of an increased load on said secondary of said first energy generating circuit.

4. The electric fence energizer of claim 1, in which said responsive means includes a light emitting diode connected across said secondary of said first energy generating circuit, and, an optical receiver connected to said control line of said control circuit.

5. The electric fence energizer of claim 1, in which said responsive means includes a light emitting diode connected across a resistor connected in series with an output line to said fence wire, and an optical receiver connected to said control line for activating said control circuit.

6. The electric fence energizer of claim 1, in which said responsive means is a thermal detector associated with said first energy detecting circuit and which is responsive to an increase in load on said first energy detecting circuit.

* * * * *